US005291100A

United States Patent [19]

Wood

[11] Patent Number: 5,291,100

[45] Date of Patent: Mar. 1, 1994

[54] LOW WATT METAL HALIDE LAMP APPARATUS

[75] Inventor: Robert J. Wood, Syracuse, N.Y.

[73] Assignee: Welch Allyn, Inc., Skaneateles Falls, N.Y.

[21] Appl. No.: 972,865

[22] Filed: Nov. 3, 1992

Related U.S. Application Data

[63] Continuation of Ser. No. 639,816, Jan. 9, 1991, Pat. No. 5,138,228.

[51] Int. Cl.[5] ..... G05F 1/00; H05B 37/02

[52] U.S. Cl. ..... 315/136; 315/290; 315/219; 315/276; 315/DIG. 7; 315/307

[58] Field of Search ..... 315/291, 307, DIG. 7, 315/276, 136, 206, 289, 290, 219

[56] References Cited

U.S. PATENT DOCUMENTS

| | | | |
|---|---|---|---|
| 3,486,070 | 12/1969 | Engel | 315/225 |
| 3,771,014 | 11/1973 | Paget | 315/136 |
| 4,356,433 | 10/1982 | Linden | 315/308 |
| 4,388,565 | 6/1983 | Rividi | 315/291 |
| 4,477,748 | 10/1984 | Grubbs | 315/306 |
| 4,513,227 | 4/1985 | Labadini et al. | 315/290 |
| 4,539,513 | 9/1985 | Ganser et al. | 315/176 |
| 4,710,746 | 10/1979 | Davenport | 315/246 |
| 4,724,360 | 2/1988 | Luursema | 315/244 |
| 4,763,044 | 8/1988 | Nuckolls et al. | 315/176 |
| 4,808,888 | 2/1989 | Wyner et al. | 315/289 |
| 4,904,903 | 2/1990 | Pacholok | 315/209 R |
| 4,904,907 | 2/1990 | Allison et al. | 315/307 |
| 4,928,938 | 5/1990 | Herone | 315/DIG. 7 X |
| 4,937,501 | 6/1990 | Ganser et al. | 315/DIG. 7 X |
| 4,952,848 | 8/1990 | Erhardt | 315/307 |
| 4,994,716 | 2/1991 | Ganser et al. | 315/291 X |

FOREIGN PATENT DOCUMENTS

| | | |
|---|---|---|
| 0294901 | 12/1988 | European Pat. Off. . |
| 0445882 | 9/1991 | European Pat. Off. . |
| 4002334 | 8/1990 | Fed. Rep. of Germany . |
| 8906894 | 7/1989 | PCT Int'l Appl. . |

*Primary Examiner*—Robert J. Pascal
*Assistant Examiner*—Michael Shingleton
*Attorney, Agent, or Firm*—Wall and Roehrig

[57] ABSTRACT

A low DC input, low wattage, high efficacy metal halide arc discharge lamp apparatus is provided which has a simplified control system including a regulated power supply, a forty kilohertz oscillator and driver for powering the bulb a main power transformer connected to the metal halide bulb; a starting and filtering inductive/-capacitive network connected to the secondary of said main power transformer for start up and running the arc discharge bulb, and a power output sensing and emergency shutdown control circuit for safety shutdown of the system should a failure occur in the lamp or associated circuitry that could cause undesired sparking. An automatic mechanism for compensating for aging of the discharge bulb is also provided.

19 Claims, 3 Drawing Sheets

LOW WATT METAL HALIDE LAMP APPARATUS

This is a continuation of copending application Ser. No. 07/639,816 filed on Jan. 9, 1991 now U.S. Pat. No. 5,138,228.

BACKGROUND OF THE INVENTION

This invention relates to high efficacy, low wattage metal halide arc discharge lamps, and more particularly to an apparatus including a low wattage bulb and associated operating circuitry therefor. This application is directed to a DC ballast metal halide arc discharge lamp apparatus.

In the prior art metal halide lamps have generally been of the so called higher power type, usually over 35 or 40 watts and have included rather involved and complicated, as well as expensive control circuitry and apparatus for operating metal halide arc discharge lamps. Discharge lamp inductive/capacitive ballasts have tended to be, heavy per kilowatt of total power, have high power consumption (10%-20% of total power input) and expensive. As the demand for low wattage metal halide lamps having high efficacy, i.e., high lumens per watt, has increased, it has become increasingly important to create new and improved circuits and apparatus for starting and operating metal halide lamps in a more efficient fashion, without sacrificing efficacy. It also has been necessary in miniature applications of these low power lamps, where they are frequently installed in inaccessible locations, to provide means for automatically compensating for aging of the bulb so that the rated light output can be maintained for the life expectancy of the bulb. Further, as the size of the lamp has decreased, many portable applications have become desirable in which the physical orientation of the metal halide bulb will frequently change. It is known that changes in physical positioning of a metal halide bulb will change the operating characteristics and hence light output.

Metal halide arc discharge lamps have three basic control requirements, namely, sufficient starting voltage, lamp current regulation and for AC operation relighting of the lamp each half cycle. Because of these requirements, ballasts have tended to have large transformers, inductors and capacitors connected between the discharge lamp and a power supply, with feedback circuits, special variable magnetic paths in the transformers, and multiple transformer windings.

Also, since the metal halide low wattage lamp is particularly adapted for miniature applications involving access to remote locations, frequently involving dangerous or explosive atmospheres, safety of operation has become a concern. Traditional prior art control systems for discharge lamps generally were not concerned with the safety aspects of discharge lamp operation.

OBJECTS AND SUMMARY OF THE INVENTION

Accordingly, it is an object of the present invention to provide a metal halide discharge lamp and operating apparatus therefore which overcomes the shortcomings of the prior art.

It is another object of the present invention to provide a simplified lamp operating and control circuit and apparatus that allow more efficient and safer operation of metal halide discharge lamps.

It is another object of the present invention to provide a metal halide discharge lamp and control system that does not require any feedback for proper ballast and lamp operation.

It is a further object of the present invention to provide a metal halide discharge lamp and control apparatus in which an emergency shut-down is provided to prevent unwanted, discharge.

It is another object of the present invention to provide a metal halide discharge lamp and control apparatus in which an over wattage alarm is provided to announce the ending of the useful lamp's life.

It is another object of the present invention to provide a metal halide arc discharge lamp apparatus having a ballast control that will maintain a constant light output for the expected life of the bulb and for all physical orientations of the bulb during use.

It is a still further object of the present invention to provide a highly efficient control apparatus having low power consumption for the control of low wattage metal halide discharge lamps.

It is yet another object of the present invention to provide an economical, compact metal halide arc discharge lamp and ballast control apparatus.

It is yet a further object of the present invention to provide a low wattage metal halide discharge lamp and control apparatus that can be readily miniaturized so as to take up an absolute minimum of circuit board real estate, and space in an apparatus.

It is another object of the present invention to provide a metal halide lamp ballast in which the relighting problem is eliminated and the high voltage starting is facilitated.

It is a still further object of the present invention to provide a metal halide lamp ballast that is economical to construct and operate.

It is another object to provide an improved DC ballast for metal halide arc discharge lamps.

These and other and further objects of the present invention are accomplished in one embodiment in which a low wattage metal halide discharge lamp is operated from a low voltage DC power source and controlled by a switching and voltage regulation circuit with an adjustable duty cycle oscillator and driver feeding a main ballast transformer wound so that the characteristics at the secondary provide complete starting and automatic aging and position compensation for the lamp, together with power sensing and emergency shutdown circuitry for shutting down operation of the metal halide discharge lamp before undesired or hazardous arcing can occur.

BRIEF DESCRIPTION OF THE DRAWINGS

Further objects of the invention, together with additional features and advantages accruing therefrom will be apparent from the following description and drawings in which.

DETAILED DESCRIPTION OF A PREFERRED EMBODIMENT

Figure 1:
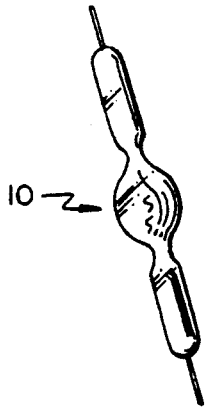
FIG. 1 is a view of a typical metal halide discharge bulb of the present invention.

Referring now to FIG. 1, there is shown a typical low voltage input, low power metal halide discharge bulb having high efficacy and capable of being packaged for miniature and subminiature applications. Bulbs of this type are shown and described in co-pending application (Improved Bulb Geometry for Low Power Metal Halide Discharge Lamp - Ser. No. 636,744, filed Dec. 31, 1990, now U.S. Pat. No. 5,138,228. and assigned to the common assignee of the present case and incorporated herein by reference. Low wattage bulbs of this type generally have an operating voltage requirement of thirty five to forty volts across the lamp electrodes, but for starting of the lamp to establish this arc, a much higher voltage on the order of thousands of volts is required. Thus, even in a low wattage lamp, not only are the control requirements complicated, but the high voltage if not carefully controlled can be extremely dangerous, particularly in hazardous environments. Also, light output tends to be more critical in low wattage applications and variations must be closely controlled.

Figure 2:
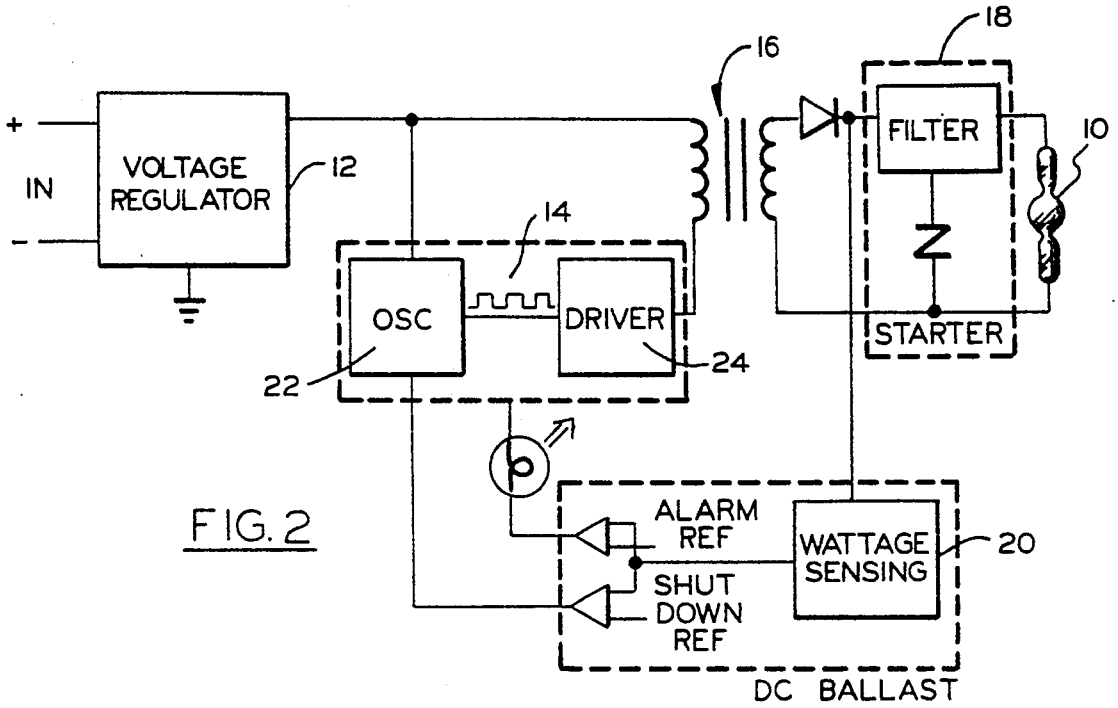
FIG. 2 is a block diagram of the control circuitry for the lamp of FIG. 1.

Accordingly, I have devised a special ballast control apparatus and circuitry for operating low wattage metal halide discharge lamps from a low voltage DC source. As shown in FIG. 2, this system comprises generally a voltage regulator 12 which has an input of nominally 12 volts from a standard lead acid battery for instance, an oscillator/driver section 14, a main ballast transformer 16, a filter/starter section 18, and a wattage sensing and emergency shutdown section 20 all for driving and controlling the lamp 10. In general, the battery voltage at the input of the voltage regulator 12 will vary with the type of battery and the age and condition of the battery so that it must be regulated and controlled to properly power the lamp. The battery input voltage is chopped up and processed to give a regulated constant output voltage for running of the rest of the system. An oscillator 22 and an oscillator driver package 14 are operated in the thirty five to forty five kilohertz range to provide a voltage that can be applied to the primary of the transformer 16, which steps the voltage up to the necessary levels for operation of the lamp 10. A driver 24 is provided in the oscillator driver section 14 to permit control of the duty cycle of the oscillator output applied to the transformer. Generally the duty cycle is set in the neighborhood of fifty percent. The stepped up voltage from the secondary of the main power transformer 16 is rectified and applied to the starter/ filter circuitry for initiating the arc in the lamp 10 and for maintaining lamp operation after starting.

It will also be seen that the power output at the transformer 16 secondary is sensed and compared with two different reference voltages: one to light an alarm light indicating the bulb 10 is approaching the end of its rated life cycle and the other to immediately shutdown the oscillator 22 so as to prevent firing of the starting circuit for the lamp 10 and possibly causing a spark or other dangerous application of high voltage to the apparatus in a hazardous environment.

Figure 3:
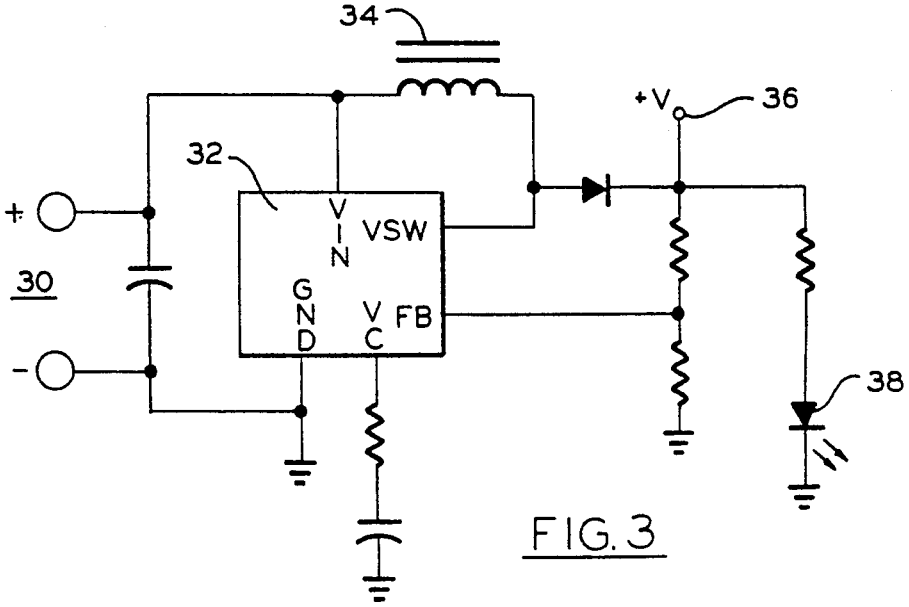
FIG. 3 is a schematic diagram of the switching and voltage regulation portion of the lamp control circuitry.
Figure 4:
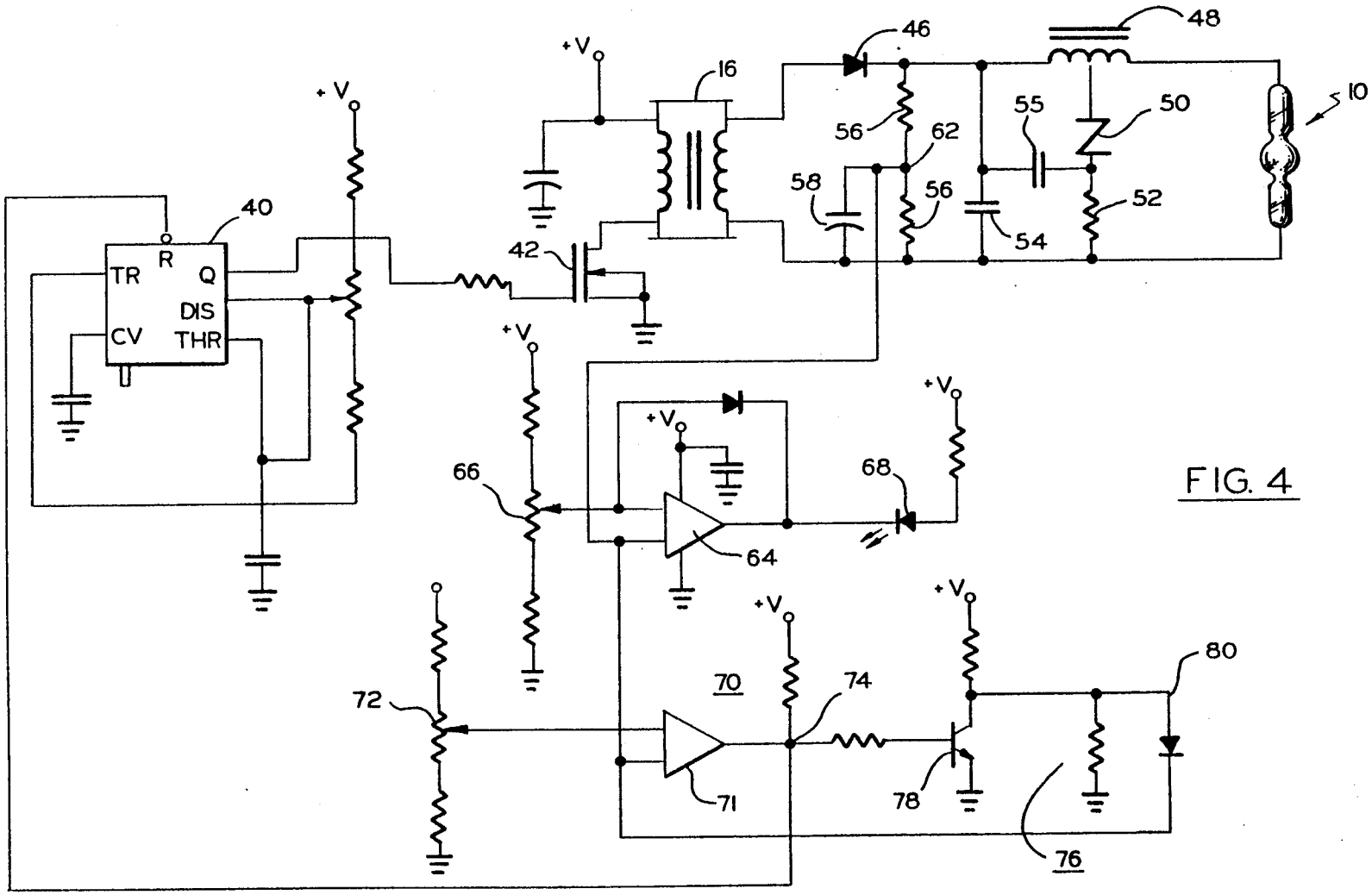
FIG. 4 is a schematic view of the operating circuitry for the lamp of FIG. 1.

Referring now to FIGS. 3 and 4, the specific circuitry for the control system will be described in detail to enable one skilled in the art to practice the invention. The circuitry of FIG. 3 is basically that encompassed in the block diagram voltage regulator 12 of FIG. 2, and shows the regulated voltage power supply for the ballast according to the present invention. This comprises a switching chip 32 which switches at approximately forty kilohertz and operates by chopping the input voltage into small segments and temporarily storing the energy into an inductor 34 for use when the input voltage varies or the load changes. Thus, the input voltage at 30 can vary all the way from 6 to 15.7 volts DC and the circuit shown will automatically compensate and hold a constant voltage of fifteen volts, plus or minus one percent at point 36. This can be accomplished at a power efficiency of approximately ninety five percent over the range of eleven to fifteen watts and provides DC regulated power for use throughout the rest of the ballast network for operating a metal halide discharge bulb. As can be seen in FIG. 3, the chopped voltage output from the chip 32 is rectified and smoothed to provide the regulated fifteen volts, plus or minus one percent at point 36. An LED indicator light 38 is provided to indicate when the power supply is operating in proper fashion. The voltage output at 36, also indicated as +V, is then fed to the circuitry in FIG. 4 at all the corresponding "plus V" locations. The direct connections have been omitted for sake of clarity.

This regulated fifteen volts plus or minus one percent is required not only for the operation of the lamp at the desired voltage current characteristics of the secondary of the main power transformer, but also is necessary to provide the stable internal reference voltages for comparison purposes in the power output sensing and emergency shutdown circuits, as will be described in more detail herein. The circuit shown in FIG. 3 automatically varies the duty cycle of "power used" versus "power" stored to maintain the output voltage at the desired level, which level is chosen to fully support the operation of the metal halide lamp to be controlled by the ballast network.

Referring now to FIG. 4, the oscillator driver module 14 of FIG. 2 generally encompasses the chip 40, the resistors, capacitors and diodes associated therewith, and the driver chip 42 connected to the primary of the main power transformer 16. This module functions to provide basic AC power to the primary of the main power transformer 16 for the bulb 10. A simple timer chip 40 is operated as a forty kilohertz oscillator to develop an AC source of power that can be stepped up through the main power transformer to provide, at the secondary of the main transformer, the voltages necessary to operate the metal halide arc discharge lamp 10. The driver chip 42 is adjusted to operate the oscillator 40 at a duty cycle of approximately fifty percent so as to maintain a desired transformer output wattage within plus or minus 0.5 percent. Thus, the combination of the regulated voltage at the primary of the transformer and the preset duty cycle determines the desired preset power input to the primary of power transformer 16 and ensures that the desired wattage is available to power the lamp 10 in the secondary of the transformer 16.

The next component in the ballast system of the present invention is the main power transformer 16 which has the primary connected to the oscillator 40 and driver 42 as just described and the secondary connected through a rectifier 46 and inductor 48 to the input to the metal halide discharge arc lamp 10. A spark gap 50 is provided between the center tap of inductor 48 and the other side of the transformer to develop the triggering of the twelve kilovolt starting voltage necessary for initiating firing of the bulb 10. The inductor 48 has a suitable resistor 52 to complete the spark gap 50 connection. Charging capacitor 54 is provided to supply energy for the starting pulse applied to lamp 10. Obviously, since the input to the main power transformer 16 is at forty kilohertz, the output from the secondary will have a forty kilohertz AC component, which even after being rectified by rectifier 46, will form a sawtooth pulsed DC which for steady state operation of the lamp 10 must be smoothed to meet the operating requirements of the lamp 10 and eliminate any ignition problems.

A high impedance voltage divider network 56–58 is connected across the rectified output of the secondary of the main power transformer 16 as will be described in further detail herein in connection with the power sensing and emergency shutdown circuits of the present invention. For the rest of the description of the operation of the power operating circuit for the lamp 10, the RC network 56, 58 can be ignored.

Generally in operating a metal halide arc discharge lamp there are three requirements, namely, sufficient starting voltage, lamp current control and lamp recognition for AC type ballasts. The ballast circuit must also be able to accommodate changes in lamp operating characteristics such as internal impedance caused by different mounting or positioning of the bulb. In addition there is, over time, an aging problem that tends to cause the resistance of the lamp to increase which, if not properly compensated for, will decrease the light output of the lamp by decreasing the lumen output from the arc. Since many applications of a low power, low wattage metal halide lamp are for critical miniaturized uses, even a small percentage drop in lumen output can be extremely detrimental. Also, a small drop in lumen output in a low wattage lamp is relatively speaking, much more noticeable to the user and much more objectionable. Accordingly, a successful ballast system for the low wattage metal halide lamps must compensate for this and maintain the output of the metal halide discharge bulb throughout its rated life span. The present ballast has been found suitable for operating HID bulbs having a power output from as low as two watts to about 40 watts and an efficacy from 35 to 150 lumens/watt. For specific examples, reference is made to the copending application cited above and incorporated herein by reference.

As indicated previously, since the voltage supplied to the transformer input is constant and regulated from the power supply of FIG. 3 or other source and since the duty cycle of the oscillator 40 determines the current that will be supplied to the transformer, we thus know the input wattage which is controlled and fixed. If we subtract the core and wire losses, then the output wattage is also known and fixed for the main power transformer 16 secondary circuit. What then determines the voltage, current and resistance curves for the main power transformer 16 secondary circuit when connected to the lamp 10 is the number of transformer turns, the number of secondary turns relative to the primary turns and the wire gauge of the turns.

Figure 5:
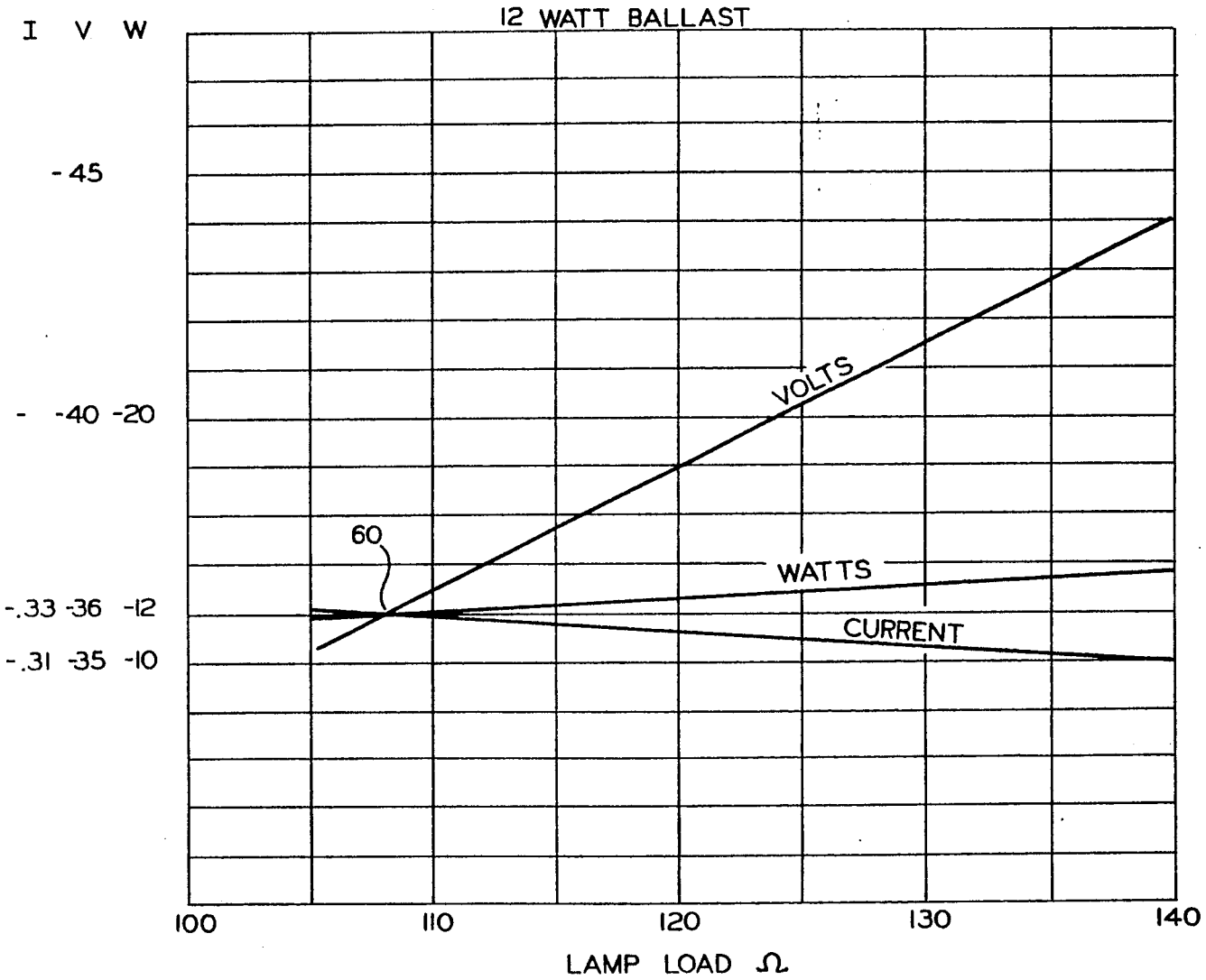
FIG. 5 is a graph showing the voltage, power and current characteristics of a transformer in accordance with the present invention.

The transformer 16 is a leakage reactance autotransformer wound to have the characteristics of high open circuit voltage with low or zero current and a low voltage higher current full load condition. These latter characteristics are shown in FIG. 5 for a particular transformer and lamp and provide the automatic compensation for electrode wear and lamp aging described herein under load conditions. This high voltage no-load characteristic of transformer 16 is used to provide the high ignition voltage needed to start operation of lamp 10. When lamp 10 is not operating, it appears as an open circuit to the transformer 16 secondary. The secondary voltage output rapidly climbs until it exceeds the 230 volts necessary for spark gap 50 to conduct. At this point spark gap 50 becomes in effect a direct short to ground and through inductor 48 and capacitor 54 applies a kilo volt pulse with sufficient energy to lamp 10 to initiate conduction. Immediately upon conduction, the transformer secondary voltage drops rapidly in accordance with its leakage reactance characteristics extinguishing spark gap 50 and operating lamp 10 as shown in FIG. 5.

If for some reason lamp 10 does not fire, spark gap 50 would continue to spark pulsing lamp 10 with consequent undesirable wear on the electrodes and other circuit components. Since a single pulse may not always be sufficient to fire lamp 10 under all conditions capacitor 55 with resistor 52 allows a controlled pulsing, approximately once per second, until the emergency shutdown circuit 20 described in detail herein takes over and shuts the ballast and lamp off.

Thus, in operation the output of the main power transformer 16 is first rectified by the rectifier 46 and is then applied to the inductor 48, which in turn is connected to one side of the lamp 10. On start-up, the input voltage to the transformer will rapidly reach the fifteen volt regulated point, and the secondary voltage correspondingly will attempt to increase very rapidly to something on the order of three-hundred volts or so, depending on the exact circuit and lamp installed. As the voltage reaches approximately two-hundred-and-thirty volts, the spark gap 50 will arc as described above and the inductor 48 becomes in effect, a peaking auto transformer. The inductor 48 is wound such that the "primary" has something like eight turns and the "secondary" has something like three-hundred turns, giving you approximately a forty fold increase, in voltage, which is applied directly to the lamp 10. Thus, the two-hundred thirty breakdown voltage of spark gap 50 is boosted through the inductor 48 to some twelve kilovolts which is sufficient to cause the lamp 10 to fire initiating the arc across the electrode gap. Once the arc is established, the voltage across the lamp quickly drops back to its operating voltage in the thirty-five to forty volt range and the spark gap 50 is extinguished. At this point, the inductor 48 begins to function as a smoothing device to provide essentially a constant DC operating voltage of thirty five to forty volts from the pulsed and rectified voltage provided by the secondary of the main power transformer 16.

For a given set of transformer, lamp, and circuit parameters, a set of voltage, current and wattage curves relative to lamp resistance can be drawn and one such particular set is shown in FIG. 5. In FIG. 5, the lamp resistance for a twelve watt metal halide arc discharge lamp is shown plotted along the abscissa varying from one hundred to one hundred forty ohms. On the vertical or ordinate line there are three scales, one showing current in tenths of an amp, one showing volts from thirty to forty five, and one showing wattage from ten to thirty watts. In the particular example chosen, the lamp 10 has a resistance of one hundred and eight ohms at twelve watts of power, and as can be seen, the three curves for volts, current and watts pass through this point 60. Each particular transformer 16 will have a particular set of curves, generally similar to the curve shown in FIG. 5, but with the starting point basically being found by the installed lamp 10 on an empirical basis after installation in the circuit. Regardless of where the lamp starts within the general confines of the chart of FIG. 5, the following operation of the lamp and the ballast circuit shown will adhere to the characteristics shown. The lamp load tends to increase with age due to electrode wear, so that the resistance increases. As one moves to the right on FIG. 5 for any particular lamp resistance, we can see what happens to the volts, current, and watts. As may be readily seen, when the load resistance increases, the current through the lamp will tend to decrease but because the voltage increases, more rapidly than the current decreases, a slight increase in power is obtained. By properly adjusting these relationships through the design of the transformer and the lamp circuit, the increase in watts out can be controlled so as to compensate for any decrease in lumen output of the lamp 10 due to the decreased current and thereby maintain the light output constant. Similarly, if the resistance of the lamp changes due to a change in mounting positions, the operating point will move left or right in FIG. 5 and the circuit will automatically compensate to keep the power output constant within ±0.5 percent and hence the light output.

Inspection of FIG. 5 indicates that the output current and voltage are both linear functions of the lamp resistive load.

$$\frac{\Delta\text{Output volts}}{\Delta\text{load resistance}} \approx \frac{44-36}{140-108}$$

$$\frac{\Delta\text{Output current}}{\Delta\text{load resistance}} \approx \frac{310-330}{140-108}$$

$$\frac{\Delta\text{Output volts}}{\Delta\text{Output current}} \approx -\frac{8}{20}$$

It is evident that the output voltage of transformer 16 has an inverse proportional relationship to the output current as the resistive lamp load varies.

For example, as shown in FIG. 5 a twelve watt output lamp positioned in the circuit of FIG. 4 results in a current of three-hundred-thirty (330) milliamps and a voltage of thirty-six (36) volts with a lamp resistance of one-hundred-eight (108)ohms. If, for instance, the lamp resistance over time should change to one-hundred-thirty ohms, with the circuit described and the transformer 16 the results in the three variables are: current drops to approximately two-hundred-sixteen (216) milliamps, the voltage rises to forty-three (43) volts and the power rises to about 13.1 watts. All of this would occur automatically due to the design and construction of the transformer and associated circuits. The lamp output in lumens remains essentially constant since the increase in power applied to the lamp offsets any loss due to the wearing of the electrodes and the increasing space therebetween. Thus, it is apparent that with the main power transformer 16 and the circuitry shown in FIG. 4, aging of the bulb 10 is automatically compensated for so as to maintain a constant light output over the life of the lamp 10. After some period of time, resistance values would no longer continue to change on a straight line, as shown in FIG. 5 and the circuit no longer could compensate for the change in resistance in the bulb. Normally, this indicates the useful life of the lamp has been exceeded and the bulb must be discarded.

It can thus be seen and appreciated that I have provided a control and operating circuit for a metal halide low wattage discharge arc lamp that requires no feedback, no switching or . other regulating nor any auxiliary windings on the main power transformer that must be switched in and out as the lamp is started and as it is operated, all of which contribute to this very simplified yet highly effective and very economical metal halide discharge lamp apparatus.

Referring now to FIGS. 2 and 4, the power sensing and emergency shutdown aspects of the present invention will be described in detail. Not only are arc discharge lamps of the metal halide type susceptible to decreased light output upon aging and wearing of the electrodes, but also if too much power is applied to an arc discharge lamp of the metal halide type, serious damage can occur to the lamp and in an extreme case the lamp can be destroyed. Overheating of the ballast with the consequent fire hazard is another potential problem. Although the curves of FIG. 5 will not continue on an ever-increasing upward slope some control and limit must be exercised to ensure safety of the people using such a lamp and the environment in which it is located. This circuit will not allow itself to remain on in an unloaded or overloaded output mode. This is particularly important in hazardous applications in which the miniaturized low wattage lamps frequently are found.

Accordingly, I have provided a sensing and emergency shutdown circuit for monitoring the power output applied to the lamp and for maintaining it within predetermined safe limits. As mentioned previously, the voltage divider network 56 is provided to sense the output voltage of the transformer 16 secondary which since the input power is carefully controlled, as described above, will be a close approximation of the power output and can be used to compare against preset standards for control and emergency shutdown. As indicated in FIG. 4, if the voltage at the lamp 10 in normal operation is thirty-six volts, for instance, the voltage at point 62 will be one-tenth or approximately 3.6 volts which is then fed to the transistor 64 in a comparator network and compared with a predetermined voltage set by the pot 66 in a resistor network connected between the regulated voltage and ground. This voltage, for instance, may be set at 4.3 volts, which is basically the voltage at point 62 plus the standard drop through the transistor 64 of 0.7 volts. When the voltage on the transistor starts to exceed this, it would then turn on the transistor 64 which in turn would turn on the LED light 68 which would show up on the control panel to indicate that the lamp 10 is starting to age and is approaching the end of its useful life. These numbers, of course, can be selected empirically to reflect the desired life expectancy of the lamp and to provide time for necessary replacement schedules and the like.

The voltage divider 56, together with capacitor 58 provides a 15 second time constant to prevent the voltage comparator transistor 64 from reacting to every transient that comes along. With this fifteen second time constant built into the voltage applied to the first comparator network for transistor 64 it ensures that the red light of the LED 68 does not flicker on and off. Thus, momentary transients that exceed the comparator levels will not cause the light 68 to turn on. Hystersis is also built into this subsystem to prevent the red light from turning off due to transients once it is lit. A second comparator circuit 70 is provided to ensure that the lamp does not self-destruct and to shut down the system on lamp failure or other "open circuit" condition to prevent hazardous or unwanted start up attempts. Again, the voltage from point 62 is fed down to the transistor chip 71 where it is compared to a voltage from another network pot 72 which can be preset to any desired value for instance, 4.7 volts. This would mean that should the lamp circuit become "open", the voltage across resistor network 56 will exceed 47 volts and apply over 4.7 volts to transistor 71 which would immediately conduct and would, through the resistive network shown at 74, raise the voltage fed back to the oscillator chip 40 and shut the oscillator down and thus shut off any power being applied to the main power transformer 16. This limit obviously can be set at any desired level to provide whatever protection it is deemed prudent for the circuitry and to shut the device down long before any damage can occur. For instance, in one particular embodiment, the first level would be set at fourteen watts and the second emergency shutdown level would be set to trip at 15 watts of secondary power output.

The emergency shutdown section also has a latching network shown generally at 76 which latches the emergency shutdown circuit in the off condition until the entire ballast network is powered down and completely restarted. This prevents repetitive cycles of attempted starts, for instance, or other repetitive efforts to power up the system which could be dangerous under certain environmental and hazardous operating situations. Once the system is shut off and the capacitors have been fully discharged, then a restart cycle can be initiated just as in the beginning of the foregoing description and operation will commence to take place as indicated. If the fault still exists, the system will immediately shutdown again, generally within three seconds of an attempt at startup and be latched in shutdown again. The latching circuit works basically through the conduction of the transistor 71 when the comparative voltage turns it on, which in turn allows the transistor 78 to conduct applying a voltage of seven-and-a-half volts at point 80 which translates to 6.8 back through the shutdown network and holds the transistor 71 in conduction to shut off the oscillator 40.

In addition to the first comparator indicating when the aging factor for lamp 10 exceeds a predetermined value, the emergency shutdown network provides a safety feature not available or found in any prior art ballast known to applicant. For instance, if the lamp 10 will not start due to either a broken electrode or cracked envelope or disconnected lamp or some such malfunction, the main power transformer 16 will, as it is supposed to, cause the voltage at the secondary to rise rapidly toward the starting level, thus very quickly exceeding the thirty-five to forty volts operating level which in turn will raise the voltage at point 62 very rapidly above the comparator point 4.7 volts at point 72 and immediately trigger the shutdown through the transistor 71 and latching mechanism 76, as described in the foregoing paragraphs. The time delay circuit is not effective for emergency shutdown, since with a lamp "open circuit" condition, capacitor 58 doesn't have to fully charge up before the voltage at point 62 exceeds 4.7 and triggers the immediate shutdown of the oscillator 40. As indicated above, this emergency shutdown action will normally take, for the example cited, about three seconds. Usually, this would prevent firing of the lamp or discharge of a spark through the spark gap 50, in case of a malfunction so that a dangerous build up of the twelve kilovolt starting voltage would be avoided and no spark or other hazardous discharge would be created in a hazardous environment.

Thus, by sensing the output of the ballast system as it is applied to the lamp, not only is aging of the lamp shown, but I provide a safety shutdown to prevent hazardous discharges, sparks, or attempts to start a defective, broken or "open" lamp in a hazardous environment. This protects operators and others who might be in contact with the apparatus, should there be a failure of the lamp bulb itself or should some other component of the system fail that did not disable the main power transformer output. Again, it is apparent that the circuitry is very simple, has very low power drainage requirements and is very fast acting so as to be totally responsive to almost any operating environment for a metal halide discharge arc lamp. Since this circuit is direct acting and self-compensating, without feedback or other complicated control circuits, the power consumed by the ballast is very minimal and its percentage effect on a low watt metal halide discharge arc lamp is minimal. The components required for this circuit are very cheap, easily manufactured components and result in a very economical ballast circuit both in initial cost as well as operating cost during use.

While this invention has been explained with reference to the structure disclosed herein, it is not confined to the details as set forth and this application is intended to cover any modifications and changes as may come within the scope of the following claims.

What is claimed is:

1. A high efficacy low watt metal halide arc discharge apparatus having a lamp and a ballast control circuit comprising in combination:

a metal halide arc discharge lamp having a low power output;

a dc power source sufficient to operate said arc discharge lamp at a desired power level;

means for regulating the output voltage of said DC power source to a predetermined value;

a transformer having a primary and a secondary winding; said transformer being wound to have the characteristics that the output voltage of the transformer is inversely proportional to the output current of the transformer, and the lower output of the transformer is substantially constant when the secondary is connected to a varying resistive load;

an oscillator circuit switchably connected to said transformer primary winding to provide lamp operating power to said transformer;

switching means connecting and disconnecting said oscillating circuit to said transformer primary winding to limit the power input to said transformer;

said transformer secondary winding being connected to said arc discharge lamp;

a rectifier connected in series with said arc discharge lamp and the transformer secondary to convert the oscillator output to a pulsed DC lamp operating power; and a starting and filtering inductive/capacitive network connected to said transformer secondary and said discharge lamp for both generating a high starting voltage and smoothing said pulsed DC operating power, said network being coupled to said lamp and supplying smooth DC operating power thereto;

so that said lamp can be started and operated at rated light output while automatically compensating for changing lamp resistance.

2. A lamp apparatus according to claim 1 wherein said discharge lamp comprises a high efficacy arc discharge lamp having a power output of from 2 watts to 35 watts and an efficacy of from 35 lumens per watt to 150 lumens/watt.

3. A lamp apparatus according to claim 1 further including a stable regulated power supply for operating the apparatus having a variable low voltage DC input and a constant DC voltage output.

4. A lamp apparatus according to claim 3 wherein when said power supply input voltage ranges from 6.0 VDC to 15.7 VDC, said power supply output voltage is held to 15 VDC, plus or minus one percent over a power output range of 11–15 watts.

5. A lamp apparatus according to claim 1 further including a power output sensing and emergency shut down circuit having:

means for sensing the power output of the lamp;

means for converting the sensed power output to a voltage;

means for comparing said converted power output voltage to a predetermined voltage; and means for disabling the stable oscillator when said converted power output voltage exceeds the predetermined voltage.

6. A lamp apparatus according to claim 5 further including latching means for maintaining said stable oscillator disabled until the ballast control circuit is returned to start up condition.

7. A lamp apparatus according to claim 1 wherein the duty cycle of said switching means can be varied to set the power output of the transformer secondary to a preselected wattage within plus or minus 0.5 percent.

8. An apparatus according to claim 2 wherein said arc discharge lamp has a power output of 2.5 watts, 12 or 20 watts.

9. A low DC voltage input ballast for operating a metal halide arc discharge lamp which comprises:

a DC power source sufficient to operate an arc discharge lamp at a desired power level;

means for regulating the output voltage of said DC power source to a predetermined value;

an oscillator having an operating frequency between 30–50 kilo hertz for providing a source of AC operating power to the lamp to be operated;

driver means connected to said oscillator for limting the AC power oscillator operation to a 40%–60% duty cycle;

a transformer having a primary winding connected to said driver means and a secondary winding connected to the lamp to be operated, said transformer being wound to provide substantially constant power to the lamp when the internal resistance of the lamp changes;

rectifying means connected to the secondary of said transformer for converting said oscillator AC operating power to a pulsed DC operating power;

a starting and filtering inductive/capacitive network connected to the secondary of said transformer for generating a high starting voltage and smoothing said pulsed DC operating power;

power output sensing means connected to said transformer secondary winding;

comparator means connected to said power output sensing means for determining when said transformer secondary winding power output exceeds a predetermined limit; and alarm and emergency shutdown circuitry connected to said comparator means for actuating an indicating means when a first power output level is sensed and shutting down said oscillator when a second higher power output level is sensed.

10. A ballast according to claim 9 wherein said transformer secondary output voltage is inversely proportional to the secondary output current, directly proportional to the resistance of the lamp to be operated, and has several times the number of turns necessary to provide the operating voltage for the metal halide arc discharge lamp to be operated whereby increased voltages for starting and aging purposes are automatically available to the lamp to be operated.

11. A ballast according to claim 9 wherein said transformer magnetic circuits, wire gauge and number of turns are chosen to yield characteristic curves when connected to a twelve watt output metal halide arc discharge lamp, such that as the internal resistance of the arc discharge lamp increases the transformer output current decreases and said transformer output voltage increases.

12. The method of controlling and operating a low power metal halide are discharge lamp which comprises:

providing a source of DC power sufficient to operate the arc discharge lamp;

regulating the voltage output of said source of DC power to a predetermined value;

providing an oscillator, having a two digit kilohertz frequency, to furnish operating power to the lamp;

controlling the duty cycle of said oscillator to a predetermined amount so as to apply the desired operating power to the lamp;

providing a transformer for converting said oscillator voltage and current to desired levels for energizing the lamp, said transformer being wound to have the characteristic that a constant power output is provided to the lamp when internal resistance of the lamp varies;

connecting the arc discharge lamp to the transformer output;

rectifying and smoothing said oscillator operating power in said transformer output to apply DC power to the lamp; and providing a high voltage pulse generating means coupled to the output of said transformer for selectively applying a striking pulse to the arc discharge lamp.

13. The method according to claim 12 including winding said transformer so that as the internal resistance of the arc discharge lamp increases, the current in the transformer secondary decreases and the output voltage of said transformer increases at a rate greater than the secondary current decreases so as to increase the power applied to said arc discharge lamp to maintain light output constant from the lamp.

14. The method according to claim 12 further including providing power sensing means for monitoring the power input to the lamp to be operated and connecting said power sensing means to alarm and emergency shutdown circuitry for actuating indicating means at a first power level and shutting down the source of power at a second higher level.

15. A low power metal halide arc discharge apparatus of the type having a lamp and ballast control circuit, comprising:

a low wattage metal halide arc discharge lamp;

a regulated low voltage directed current power source; and oscillator-driver means connected to said power source for providing a voltage at a predetermined frequency to a duty cycle regulator that delivers power at said predetermined frequency and at a predetermined duty cycle to a switchless self-compensating circuit means for delivering smooth direct current to said lamp at a substantially constant power level when said lamp is operating;

said switchless means comprising a transformer coupled to said lamp;

whereby a stable light output is produced when internal resistance of the lamp changes as the lamp ages.

16. The apparatus of claim 15, further comprising means coupled to said transformer in said switchless circuit means for generating an ignition pulse.

17. The apparatus of claim 16, wherein said means for generating an ignition pulse comprises a spark gap coupled to an inductor and a capacitor.

18. The apparatus of claim 15, further comprising:

means for sensing a magnitude of an electrical characteristic of said switchless circuit means; and an alarm circuit, connected to said means for sensing, that is actuated when said magnitude exceeds a predetermined limit;

whereby an electrical condition of said switchless circuit means is annunciated.

19. The apparatus of claim 15, further comprising:

means for sensing a magnitude of an electrical characteristic of said switchless circuit means; and a shutoff circuit, connected to said means for sensing, that disables said lamp when said magnitude exceeds a predetermined limit.

* * * * *